US005959521A

United States Patent [19]

Kohmura et al.

[11] Patent Number: 5,959,521

[45] Date of Patent: Sep. 28, 1999

[54] HIGH-VOLTAGE TRANSFORMER AND A VEHICLE-LAMP LIGHTING-ON DEVICE USING THE SAME

[75] Inventors: Yoshihiko Kohmura, Nisshin; Takafumi Oshima, Nagoya; Noriyasu Sugimoto, Konan; Minoru Yasuda, Nagoya, all of Japan

[73] Assignee: NGK Spark Plug Co., Ltd., Nagoya, Japan

[21] Appl. No.: 09/097,658

[22] Filed: Jun. 16, 1998

[30] Foreign Application Priority Data

Jun. 16, 1997 [JP] Japan ..... 9-176355

[51] Int. Cl.[6] ..... H01F 27/30

[52] U.S. Cl. ..... 336/198; 336/96; 336/83; 336/192

[58] Field of Search ..... 336/198, 96, 165, 336/83, 192, 196, 219, 185

[56] References Cited

U.S. PATENT DOCUMENTS

| | | | |
|---|---|---|---|
| 4,725,805 | 2/1988 | Takada | 336/83 |
| 4,769,625 | 9/1988 | Meindl | 336/65 |
| 5,559,486 | 9/1996 | Ikenoue et al. | 336/90 |

FOREIGN PATENT DOCUMENTS

| | | |
|---|---|---|
| 57-176602 | 10/1982 | Japan . |
| 59-130002 | 7/1984 | Japan . |
| 7-114805 | 5/1995 | Japan . |
| 8-315624 | 11/1996 | Japan . |
| 8-315630 | 11/1996 | Japan . |
| 8-315631 | 11/1996 | Japan . |

*Primary Examiner*—Lincoln Donovan
*Assistant Examiner*—Tuyen T. Nguyen
*Attorney, Agent, or Firm*—Morgan, Lewis & Bockius LLP

[57] ABSTRACT

In a high-voltage transformer, an insulating ring is placed on and along the inner surface of the core housing, and gaps are formed between the tips of the flange-like plates of the coil bobbin and the inner side of the insulating ring. With such a construction, the gaps and the insulating ring are provided between the coil bobbin and the inner wall of the core housing, so that the flange-like plates of the coil bobbin do not come in contact with the inner surface of cylindrical wall of the core housing. Therefore, a surface distance of the coil bobbin ranges to a contact surface of the coil bobbin where it comes in contact with the front wall of the core housing. The surface distance is elongated. The voltage drop by the creepage discharge does no occur.

8 Claims, 7 Drawing Sheets

HIGH-VOLTAGE TRANSFORMER AND A VEHICLE-LAMP LIGHTING-ON DEVICE USING THE SAME

FIELD OF THE INVENTION

The present invention relates to a high-voltage transformer used for a vehicle-lamp lighting-on device, an ignition device, and others, and a vehicle-lamp lighting-on device using the same.

FIELD OF THE INVENTION

A discharge lamp, e.g., a metal halide lamp, is used for a head lamp of a vehicle. The discharge lamp is detachably attached to a socket provided in the front of the vehicle. In this case, the electrodes of the discharge lamp are connected to the terminals of the socket. In this state, electric power is supplied from a power source through the socket terminals to the discharge lamp to light on the lamp. The power source supplies voltage of about 400 V to a lighting-on transformer. The transformer then boosts the voltage and produces a high voltage at the secondary coil thereof, and applies it to the socket terminals.

In the device using such a high-voltage transformer for boosting voltage of 400 V to high-voltage of 13 kV, a creepage discharge frequently takes place in the high voltage region of the device. Current caused by the creepage flows along the surface of the socket to the core housing. The high voltage abruptly drops, possibly leading to lamp lighting-on failure or igniting failure.

SUMMARY OF THE INVENTION

Accordingly, an object of the present invention is to provide a high-voltage transformer which is free from the creepage problem.

A high-voltage transformer comprises: a core housing having an iron core located at the central part thereof; a coil bobbin made of insulating material, which is disposed in the core; a secondary coil being wound around the coil bobbin; a primary coil being wound around the iron core of the core housing; a high-voltage side connecting piece connected to the secondary coil, which is placed in the front side of the core housing; and a insulating member placed the inner surface of the core housing; wherein gaps are formed between the tips of the flange-like plates of the coil bobbin and the inner side of the insulating member.

With such a construction, the gaps and the insulating ring are provided between the coil bobbin and the inner wall of the cylindrical wall of the core housing, so that the flange-like plates of the coil bobbin do not come in contact with the inner wall of the cylindrical wall of the core housing. Therefore, a surface distance of the coil bobbin ranges to a contact surface of the coil bobbin where it comes in contact with the core block as the front wall of the core housing on which a high-voltage side connecting means is located. The surface distance is elongated.

In the high-voltage transformer thus constructed, a positioning protrusion is formed at a location on the insulating ring. The location is close to the low voltage side of the secondary coil on the insulating ring. The tip of the positioning protrusion of the insulating ring is made to press contact with the circumferential edge of a flange-like plate of the coil bobbin, whereby the coil bobbin is positioned so as to form the gaps in the core housing. With provision of the positioning protrusion, the gaps are made uniform around the coil bobbin and a satisfactory surface distance is secured.

The reason why the positioning protrusion is located close to the low-voltage side is that the contact of the positioning protrusion with the coil bobbin creates no creepage discharge since high voltage is not present.

PREFERRED EMBODIMENTS OF THE INVENTION

Figure 1:
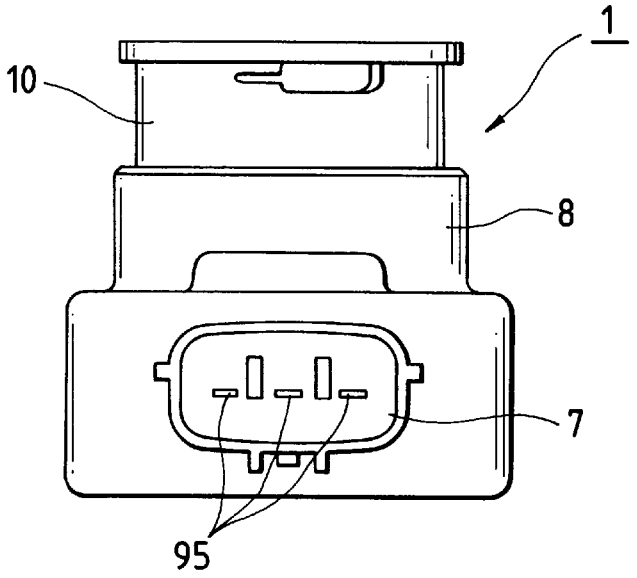
FIG. 1 is a front view showing a vehicle-lamp lighting-on device which is an embodiment of the present invention.
Figure 2:
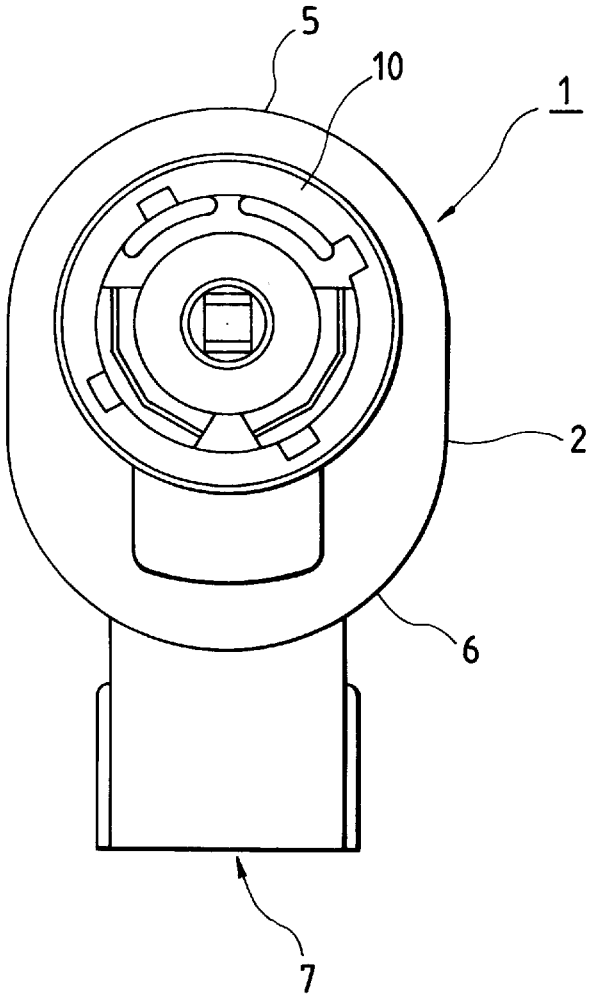
FIG. 2 is a plan view showing the vehicle-lamp lighting-on device.
Figure 3:
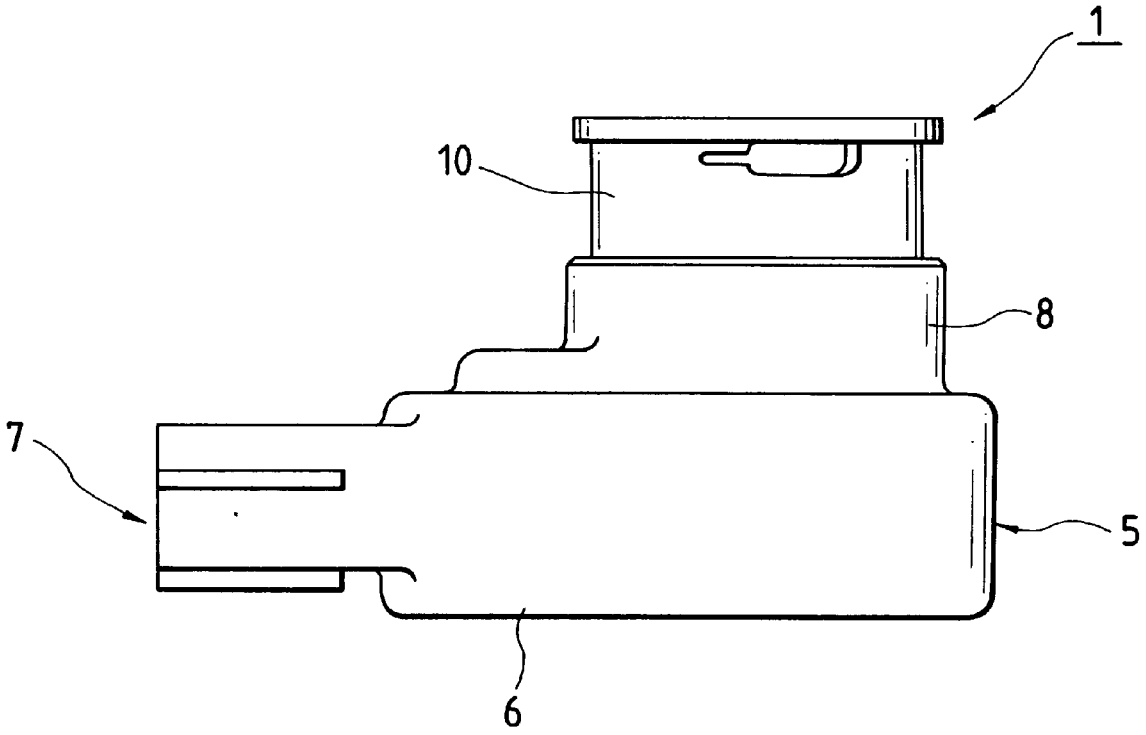
FIG. 3 is a side view showing the vehicle lamp lighting-on device.

Detailed description of the present invention will be described as follows referring to the accompanying drawings.

A vehicle-lamp lighting-on device 1 using a high-voltage transformer 30 constructed according to the present embodiment will be described with reference to the accompanying drawings. The vehicle-lamp lighting-on device 1, as shown in FIGS. 1 through 4, is generally made up of a body case 2, a socket 10 and a lighting-on transformer 30, and the like. The body case 2 and the socket 10 are both made of synthetic resin.

Figure 4:
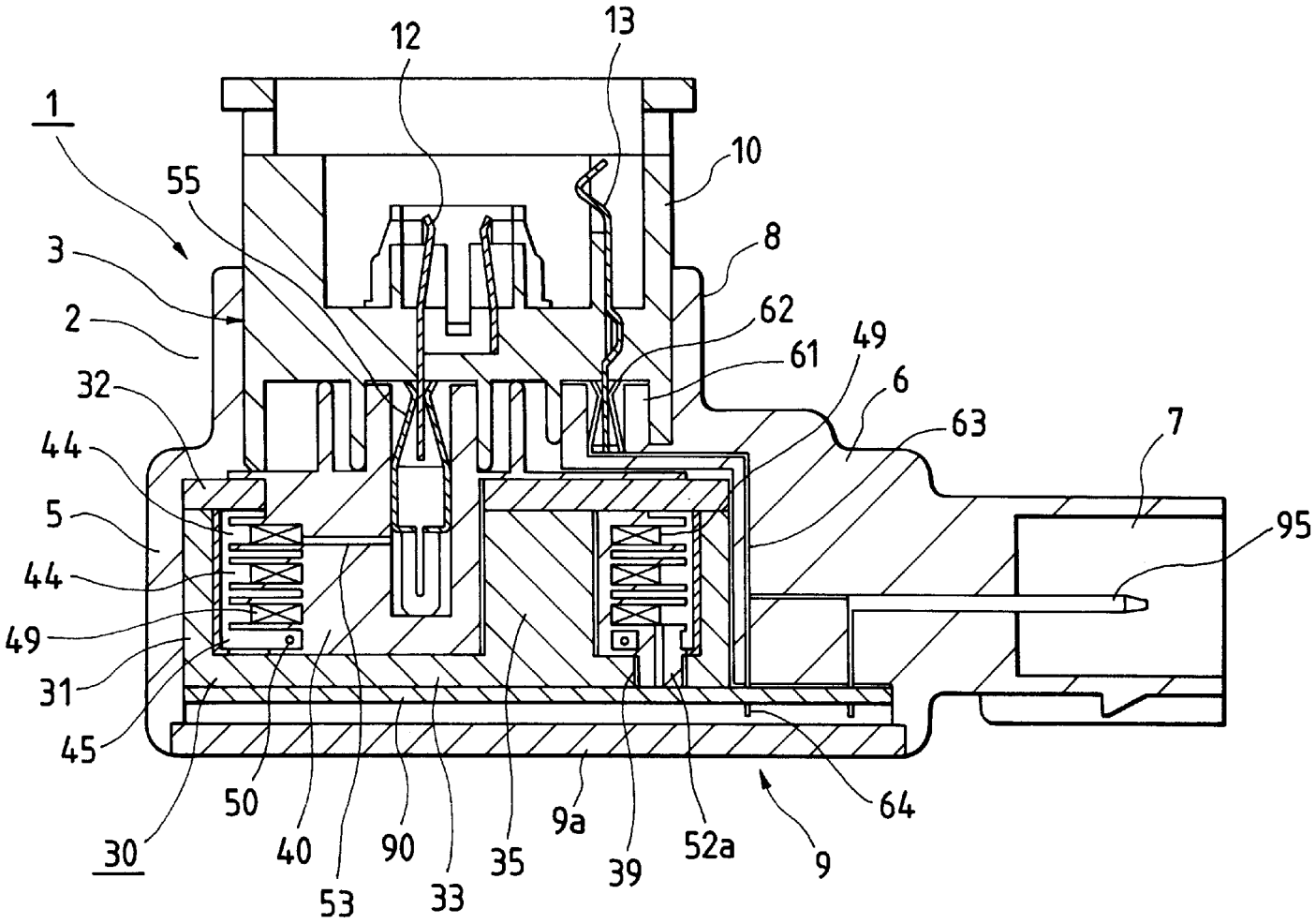
FIG. 4 is a longitudinal sectional view showing the vehicle lamp lighting-on device 1 when viewed from the left-hand side.

As shown in FIG. 4, the synthetic resin body case 2 includes a major portion 5 and an extended portion 6 extended outwardly of the circular portion 5. The front end of the major portion 5 is opened to provide a circular connection opening 3 defined by a ring-like circumferential wall 8. The extended portion 6 is shaped like U when viewed from above. A cylindrical protrusion, which has a through-hole 7 longitudinally formed therein, is protruded outward from the central part of the bottom of the U-shape of the extended portion 6. Lead wires are lead out through the through-hole 7 of the cylindrical protrusion. A printed circuit board 90 is placed on the bottom surface of the body case 2. The printed circuit board 90 is connected to the inner ends of needle terminals 95. A space is formed in the extended portion 6 of the body case 2. The space is used for mounting a circuit component (not shown), e.g., a capacitor, on the printed circuit board 90. An opening 9 is formed in the rear side of the body case 2. The lighting-on transformer 30, the printed circuit board 90 and others are inserted into the body case 2, through the opening 9. The opening 9 is covered with a cover 9*a*.

The socket 10, when attached, is inserted into the connection opening 3 of the major portion 5 of the body case 2. The socket 10, cylindrical in shape, includes a high-voltage terminal 12 located at the central part thereof and a couple of low-voltage terminals 13 (one of them is illustrated in FIG. 4), which are spaced outward from the high-voltage terminal 12.

A construction of the lighting-on transformer 30 will be described with reference to FIGS. 4 through 7B.

The lighting-on transformer 30 is constructed such that a coil bobbin 40 is placed in a core housing 31 having an iron core 35.

The core housing 31 is made of magnetic material, e.g., ferrite. A couple of core blocks 32 and 33, the outside diameters of which are equal, are coupled together into a cylindrical body of a short length, or the core housing 31. The outside diameter of the cylindrical body is selected to be equal to the inside diameter of the major portion 5 of the body case 2. A specific example of the cylindrical block is 37 mm in diameter.

Figure 8A:
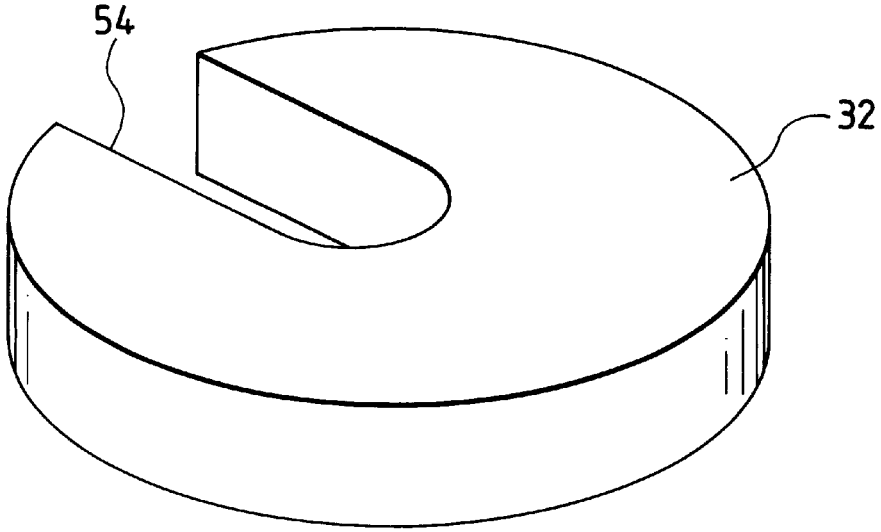
FIGS. 8A and 8B are partial enlarged views of FIG. 5.

The core block 32 of the core housing 31 is a thin disc-like block of approximately 2 mm thick, and serves as a front wall of the core housing 31. A coil bobbin 40 is injection molded onto the core block 32 into a single unit. As shown in FIG. 8A, a thorough-hole 54 is formed through the core block 32 while being located slightly deviated from the center of the core block 32.

Figure 5:
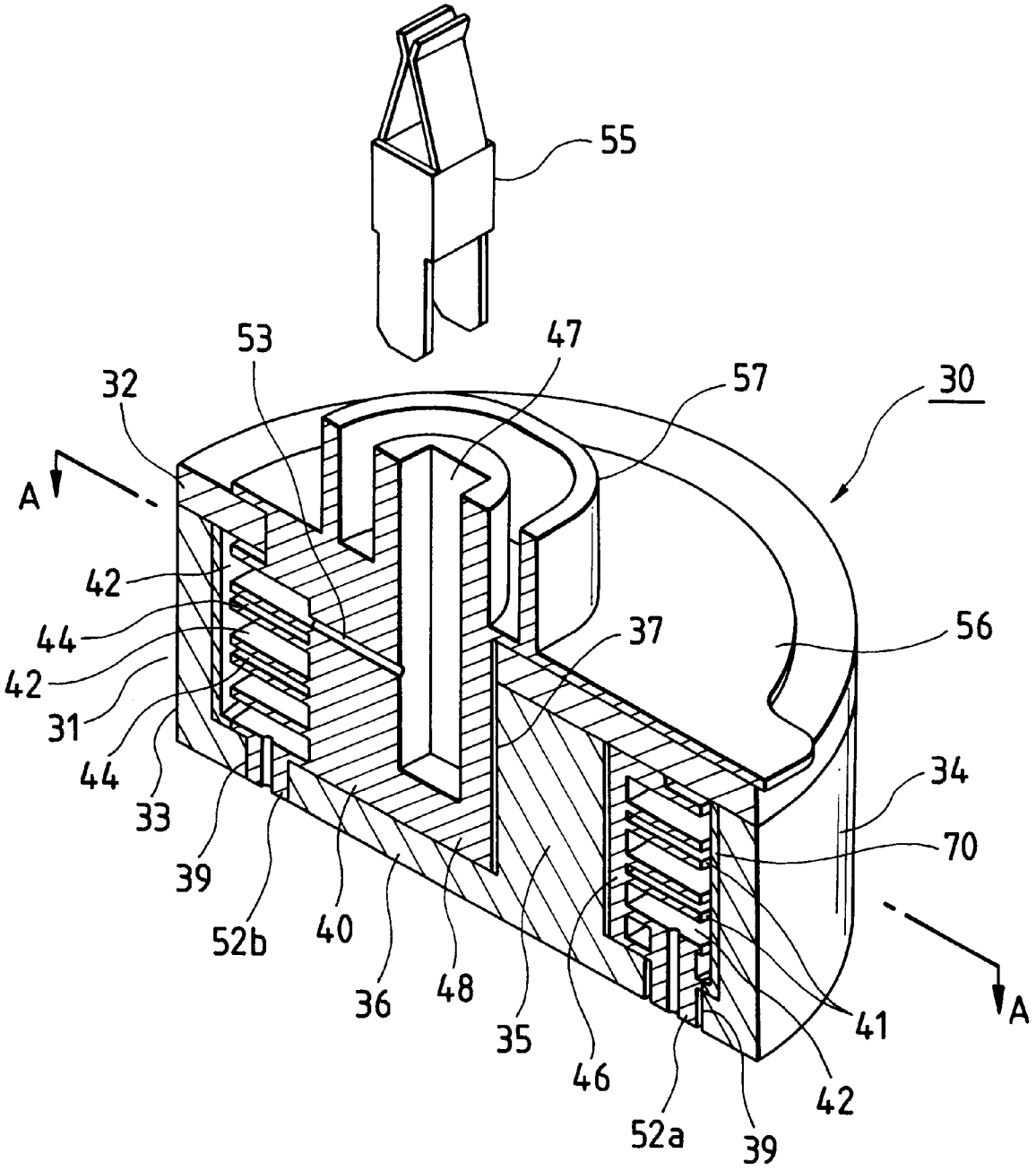
FIG. 5 is a longitudinal sectional view in perspective of a lighting-on transformer 30.
Figure 6:
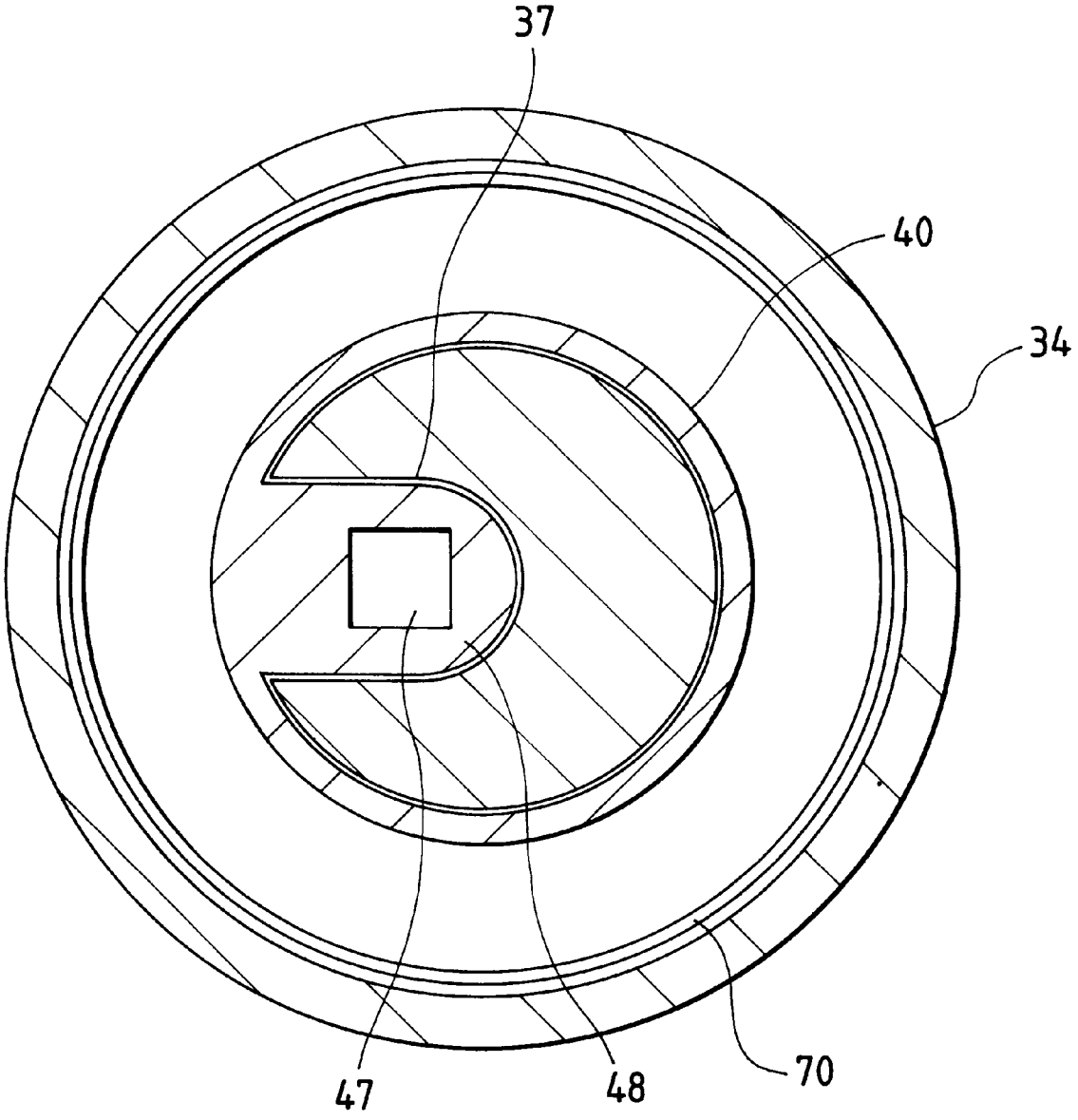
FIG. 6 is a cross sectional view taken on line A—A in FIG. 5.
Figure 8B:
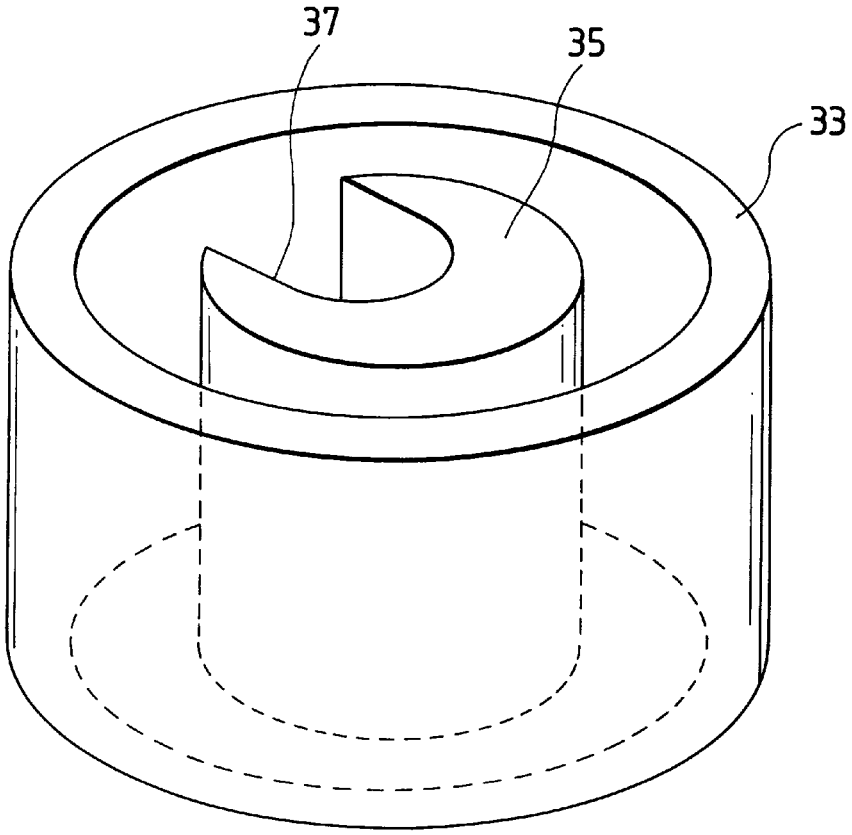

The detail of the core block 33 of the core housing 31 is illustrated in FIGS. 5 and 8B. As shown, the core block 33 includes a cylindrical wall 34, an iron core 35 and a rear wall 36 which interconnects the cylindrical wall 34 and the iron core 35. The cylindrical wall 34 is raised vertically from the outer circumferential edge of the rear wall 36. The iron core 35 is raised vertically from the central part of the core block 33. A through-hole 37 is extended passing through the iron core 35 in its lengthwise direction while being located slightly deviated from the center of the core block 33. A thick portion 48 of the coil bobbin 40 (which will be described later) is inserted into the through-hole 37. The core block 33 is manufactured as an individual component part, and, in assembling, is applied to the rear side of the unit structure including the core block 32 and the coil bobbin 40 as will be described later. Three holes 39 are formed in the rear wall 36.

If required, the iron core 35 may be provided in the core block 32, which is located on the front side of the core block 33.

A construction of the coil bobbin 40 to be integrated to the core block 32 will be described.

The coil bobbin 40 is made of synthetic resin. As shown, the coil bobbin 40 includes a cylindrical bobbin base 46 to be brought into close contact with the outer surface of the iron core 35. A plural number of flange-like plates 41 are extended radially and outwardly from the outer surface of the cylindrical bobbin base 46. The flange-like plates 41 and the inner surface of the cylindrical wall 34 of the core block 33 substantially define spaces 42, intermediate spaces 44 located between the spaces 42, and another space 45. A secondary coil 49 is successively wound in the spaces 42 and the intermediate space 44, and a primary coil 50 like a thin film is wound in the space 45. In the present invention, it is possible that the coil bobbin is made of rubber, resin such as LCP, PPE, PBT, polyimide and polyamide, and ceramic such as alumina, mica, silica, glass and $Si_3N_4$.

As shown in FIG. 5, a protruded part 52*a* and other protruded parts 52*b* (one of them is illustrated in the figure) are protruded from the rear side of the coil bobbin 40. Those protruded parts 52*a* and 52*b* are inserted into the three holes 39 (two of them are illustrated in the figure) of the rear wall 36, whereby the coil bobbin 40 and the core block 33 are coupled together. Through-holes are formed in the protruded parts 52*a* and 52*b*. Both ends of the primary coil 50 are led out through the through-holes. The winding end terminal of the secondary coil 49 and both ends of the primary coil 50 are connected to related electrical paths on the printed circuit board 90.

The coil bobbin 40 is inserted into the through-hole 37 of the iron core 35; it has the thick portion 48 that passes through the core block 32; and a connection hole 47 is formed in the thick portion 48 while being located deviated from the center of the coil bobbin 40. A shielding plate 56 that is continuous to the coil bobbin 40 is provided on the front side of the core block 32. The connection hole 47 is formed in the shielding plate 56. A cylindrical part 57 is raised from the shielding plate 56 while being coaxial with the connection hole 47.

High-voltage side connecting piece 55 is inserted into the connection hole 47 (FIG. 5). The winding start terminal (high voltage terminal) of the secondary coil 49 is introduced into the connection hole 47 through a through-hole 53 of the thick portion 48 and electrically connected to the high-voltage side connecting piece 55. The secondary coil 49 is successively wound in the spaces 42 through the intermediate spaces 44, and the winding end terminal of the secondary coil is led out to the rear side of the lighting-on transformer 30, through the protruded part 52.

Description will be given about a construction of the high-voltage transformer 30, which is essential to the present invention.

Figure 7A:
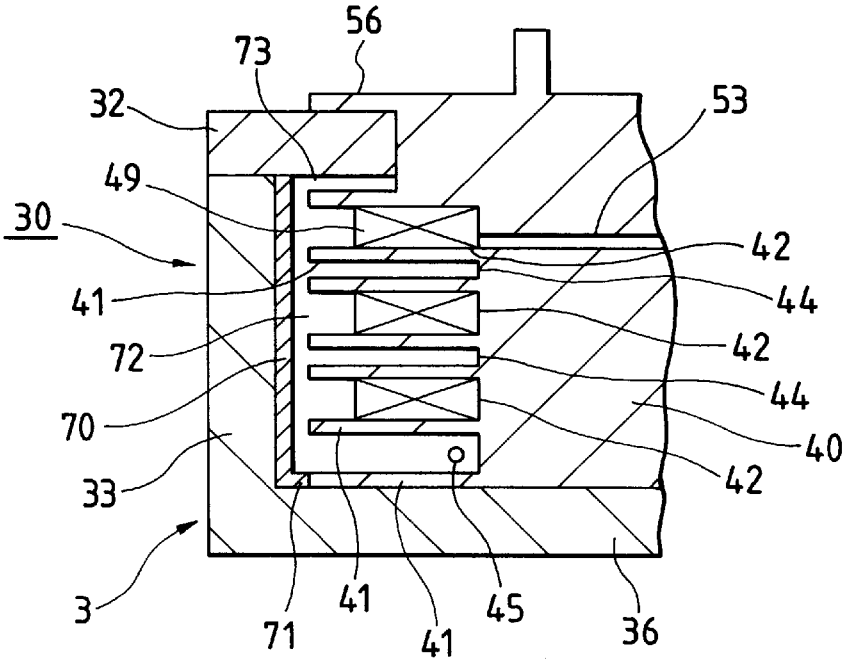
FIG. 7A is an enlarged, sectional view showing a key portion of the high-voltage transformer.
Figure 7B:
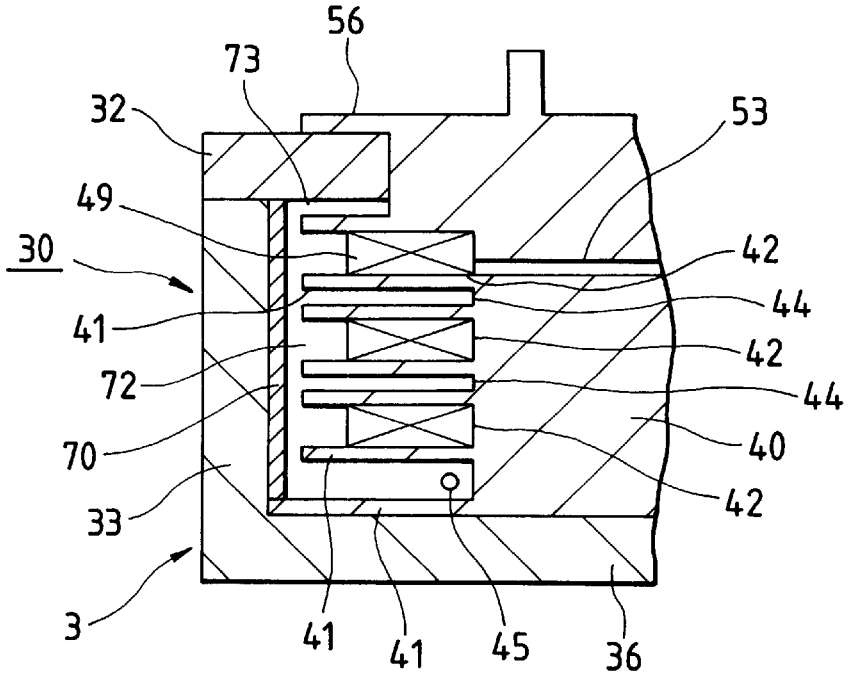
FIG. 7B is an another example of the key portion of the high-voltage transformer.

An insulating ring 70 is placed on and along the inner side of the cylindrical wall 34 of the core housing 31. The diameter of each flange-like plate 41 is selected so that the tip of the flange-like plate 41 fails to come in contact with the inner side of the insulating ring 70. Therefore, gaps 72 are formed between the tips of the flange-like plates 41 and the inner side of the insulating ring 70. To secure the gaps 72, the insulating ring 70 has a positioning protrusion 71. The positioning protrusion 71, while being protruded inward, is formed at the end of the insulating ring 70 where the ring is abutted against a portion of the rear wall 36 which is located close to the winding end terminal (low-voltage terminal) of the secondary coil 49. The height of the positioning protrusion 71 corresponds to each gap 72. More specifically, the tip of the positioning protrusion 71 of the insulating ring 70 is made to press contact with the circumferential edge of the lowermost flange-like plate 41 of the coil bobbin 40, which is closest to the rear wall 36 of the core block 33. As a result, the coil bobbin 40 is positioned with respect to the core housing 31, and the gaps 72 are secured between the tips of the flange-like plates 41 (except the lowermost flange-like plate 41) and the inner side of the insulating ring 70. If required, the gaps 72 may be impregnated with insulating material of resin, for example. It is noted that the positioning protrusion 71 is located close to the low-voltage side. The reason for this is that the contact of the positioning protrusion 71 with the coil bobbin 40 creates no creepage discharge since high voltage is not present. A gap 73 for insulation is formed between the core block 32 serving as the front wall of the core housing 31 and the uppermost flange-like plate 41. Incidentally, in this case, it is not necessary that the positioning protrusion 71 is always provided. For example, as shown in FIG. 7B, there is no positioning protrusion 71.

With provision of the insulating ring 70 and the insulating gaps 72, the coil bobbin 40 is electrically insulated from the cylindrical wall 34 of the core block 33. Provision of the insulating ring 70 prevents an aerial discharge which otherwise would occur. Because of the presence of the gaps 72, the coil bobbin 40 comes in contact with only two positions of the core housing 31; the inner wall of a fore part (high voltage side) of the core housing and the inner walls of a rear part (low voltage side). The gaps 72 separate the coil bobbin 40 from the inner wall of the insulating ring 70. Therefore, a surface distance of the coil bobbin 40 is increased, viz., it ranges from a position where the lowermost flange-like plate 41 of the coil bobbin 40 is in contact with the core block 33 to another position where the uppermost flange-like plate 41 is in contact with the core block 32.

The voltage drop in question takes place in particular in the high voltage region of the device. In this respect, a route ranging from the secondary coil 49 in the uppermost space 42 to a contact surface of the coil bobbin 40 where it comes in contact with the core block 32, through the surface of the flange-like plates 41 is a key route for the flow of current of the creepage discharge. It is noted here that the insulating gap 73 is present between the uppermost flange-like plate 41 and the core block 32 in the high-voltage transformer of the present embodiment. The presence of the insulating gap 73 considerably elongates the surface distance for the creepage to be in excess of the maximum distance within which the creepage discharge will take place.

Thus, the high-voltage transformer of the embodiment has the gaps 72 and 73, and hence is free from the creepage discharge by the high voltage produced from the secondary coil 49 of the transformer, and the voltage drop resulting from the creepage as well.

Since the high-voltage transformer 30 thus constructed is covered with the core housing 31, it has a neat, single structure. With formation of the extended portion 6, an orderly space is formed in the body case 2.

Within the connection opening 3, a couple of cylindrical portions 61 are provided at locations close to the circumferential edge of the connection opening, in association with the low-voltage terminals 13 of the socket 10. Low voltage side connecting pieces 62 are inserted into the cylindrical portions 61.

The cylindrical portions 61 are integral with the body case 2. Low-voltage metal pieces (earthing paths) 63 are coupled into the body case 2 by insert molding. One end of each earthing path 63 is put in the corresponding cylindrical portion 61, and connected to the corresponding low-voltage side connecting piece 62. The other end 64 of the earthing path 63 is led to the rear side, passed through the corresponding through-hole of the printed circuit board 90, and connected to a low-voltage path (earthing path) on the printed circuit board 90. Incidentally, in this case, the cylindrical portion 61 may be integrally connected to the low-voltage side connecting piece 62.

To form the high-voltage side connecting piece 55 or each of the low-voltage side connecting pieces 62, a metal sheet is bent to take a triangular shape (in cross section) with its apex being opened. When the socket 10 is inserted into the connection opening 3, the high-voltage terminal 12 is inserted into the opening of the high-voltage side connecting piece 55, and the two low-voltage terminals 13 are inserted into the openings of the low-voltage side connecting pieces 62, whereby electrical connection is set up. Incidentally, in this case, it is possible that the high-voltage side connecting piece 55 may be integrally connected to the connection hole 47.

The vehicle-lamp lighting-on device may be constructed in such a simple manner that the high-voltage transformer 30, the printed circuit board 90 and the like are inserted into the body case 2 through the opening 9, and the connection opening 3 is covered with the insulating shielding plate 56, and the socket 10 is inserted into and fixed to the connection opening 3.

In operation, voltage of about 400 V is applied to the lead wires that are connected to the needle terminals 95 extended into the through-hole 7. The voltage then is applied to the primary coil of the high-voltage transformer through a related circuitry on the printed circuit board 90. The transformer boosts the voltage to voltage of 13 kV or higher and the boosted voltage, while not causing a creepage discharge, is applied from the secondary winding 49 to the high-voltage side connecting piece 55 and in turn to the high-voltage terminal 12 of the socket 10.

The thus constructed vehicle-lamp lighting-on device 1 is attached to the front of the engine room of a vehicle; a discharge lamp (not shown), e.g., a metal halide lamp, is attached to the socket 10; the low-voltage terminals 13 are connected to the peripheral electrodes of the discharge lamp; the high-voltage terminal 12 is connected to the center electrode; and high voltage of 13 kV or higher is applied to the discharge lamp to light on the lamp.

It is evident that the high-voltage transformer may be applied to the ignition device of the vehicle.

As seen from the foregoing description, in the high-voltage transformer of the invention, an insulating ring 70 is placed on and along the inner surface of the core housing 31, and gaps 72 and 73 are formed between the tips of the flange-like plates 41 of the coil bobbin 40 and the inner side of the insulating ring 70.

With such a construction, the gaps 72 and 73 and the insulating ring 70 are provided between the coil bobbin 40 and the inner wall of the core housing 31, so that the flange-like plates 41 of the coil bobbin 40 do not come in contact with the inner surface of cylindrical wall 34 of the core housing 31. Therefore, no real discharge takes place. Further, a surface distance of the coil bobbin 40 ranges to a contact surface of the coil bobbin 40 where it comes in contact with the front wall of the core housing 31. The surface distance is elongated. A voltage drop by the creepage discharge does not occur.

Further, the positioning protrusion 71 is formed at a location on the insulating ring 70, which is close to the low voltage side of the secondary coil 49 on the insulating ring 70. The tip of the positioning protrusion 71 of the insulating ring 70 is made to press contact with the circumferential edge of a flange-like plate 41 of the coil bobbin 40, whereby the coil bobbin 40 is uniformly positioned within the core housing 31. With provision of the positioning protrusion 71, the gaps 72 are made uniform around the coil bobbin 40 and a satisfactory surface distance is secured.

What is claimed is:

1. A high-voltage transformer comprising:

a core housing having a front side, an inner surface, and an iron core located at central part of said core housing;

a coil bobbin made of insulating material and having flange-like plates, said coil bobbin being disposed in said core housing;

a secondary coil being wound around said coil bobbin;

a primary coil being wound around said iron core of said core housing;

a high-voltage side connecting piece connected to said secondary coil, and being located in the front side of said core housing; and an insulating member having an inner side and being located on the inner surface of said core housing;

wherein the flange-like plates of said coil bobbin have tips that are separated from the inner side of said insulating member by a first preselected distance.

2. A high-voltage transformer according to claim 1, wherein said insulating member includes a positioning protrusion having a tip and being located near the low voltage side of said secondary coil;

wherein the tip of said positioning protrusion abuts a peripheral edge of at least one of the flange-like plates of said coil bobbin so that the first preselected distance between said flange-like plates and the inner side of said insulating member is uniform.

3. A high-voltage transformer according to claim 1, further comprising: a core block serving as a front wall of said core housing, and an uppermost flange-like plate being one of the flange-like plates, wherein said core block and said uppermost flange-like plate are separated by a second preselected distance.

4. A high-voltage transformer according to claim 1, further comprising:

a body case, a connection opening located in said body case, a socket having low voltage terminals and being connected to said body case at said connection opening, a pair of first cylindrical portions provided at locations close to the circumferential edge of the connection opening, and being near the low-voltage terminals of the socket, and low-voltage side connecting pieces located within said cylindrical portions.

5. A high-voltage transformer according to claim 4, wherein said pair of first cylindrical portions are integral with said body case.

6. A high-voltage transformer according to claim 4, wherein each of said low-voltage side connecting pieces is a metal sheet having two ends and a triangular shape, with the ends of said metal sheet being separated at an apex of said triangular shape.

7. A high-voltage transformer according to claim 1, further comprising:

a second cylindrical portion located in said coil bobbin, and a high-voltage side connecting piece located within said second cylindrical portion of said coil bobbin, and being electrically connected to a high-voltage terminal of the socket.

8. A high-voltage transformer according to claim 7, wherein said high-voltage side connecting piece is a metal sheet having two ends and a triangular shape, with the ends of said metal sheet being separated at an apex of said triangular shape.

* * * * *